US005605644A

United States Patent [19]

Morhenne

[11] Patent Number: 5,605,644

[45] Date of Patent: Feb. 25, 1997

[54] YARN HEATING APPARATUS

[75] Inventor: Siegfried Morhenne, Breckerfeld, Germany

[73] Assignee: Barmag AG, Remscheid, Germany

[21] Appl. No.: 387,751

[22] PCT Filed: Jun. 9, 1994

[86] PCT No.: PCT/EP94/01886

§ 371 Date: May 24, 1995

§ 102(e) Date: May 24, 1995

[87] PCT Pub. No.: WO94/29501

PCT Pub. Date: Dec. 22, 1994

[30] Foreign Application Priority Data

Jun. 15, 1993 [DE] Germany ..... 43 19 796.5

[51] Int. Cl.[6] ..... F27B 9/28; F27D 11/02; D01H 13/28

[52] U.S. Cl. ..... 219/388; 57/284

[58] Field of Search ..... 219/388, 469, 219/470, 471; 392/417; 57/282, 284

[56] References Cited

U.S. PATENT DOCUMENTS

| | | | |
|---|---|---|---|
| 2,990,670 | 7/1961 | Kingsbury . | |
| 3,559,965 | 2/1971 | Ishida et al. | 219/388 |
| 4,567,721 | 2/1986 | Kuroda et al. . | |
| 4,809,494 | 3/1989 | Dammann . | |
| 5,138,829 | 8/1992 | Tanae et al. | 57/288 |
| 5,148,666 | 9/1992 | Bauer et al. | 57/284 |
| 5,313,776 | 5/1994 | Humbrecht et al. | 57/284 |
| 5,339,617 | 8/1994 | Dammann . | |
| 5,353,583 | 10/1994 | Tanae et al. . | |
| 5,404,705 | 4/1995 | Yanagihara et al. | 57/284 |
| 5,438,820 | 8/1995 | Nakahara et al. | 57/284 |

FOREIGN PATENT DOCUMENTS

| | | |
|---|---|---|
| 0412429 | 2/1991 | European Pat. Off. . |
| 2451415 | 10/1980 | France . |
| 2534598 | 2/1977 | Germany . |
| 39 26 316.9 | 9/1989 | Germany . |
| 890057 | 8/1959 | United Kingdom . |

*Primary Examiner*—Teresa J. Walberg
*Assistant Examiner*—J. Pelham
*Attorney, Agent, or Firm*—Bell, Seltzer, Park & Gibson, P.A.

[57] ABSTRACT

A yarn heating apparatus for use in a false twist crimping machine wherein the advancing yarn is guided along a laterally zigzagged path through the apparatus by means of yarn guides which are alternately arranged on opposite sides of the yarn. The yarn guides are of cylindrical configuration so as to present broadly curved contact surfaces in engagement with the yarn.

17 Claims, 4 Drawing Sheets

YARN HEATING APPARATUS

BACKGROUND OF THE INVENTION

The present invention relates to an elongate yarn heater for use in a false twist crimping machine.

U.S. Pat. No. 5,148,166 discloses a heating apparatus subjecting a synthetic filament yarn to advance along a zigzagged path. This known heating apparatus allows to select during construction the looping angle on the yarn guides and the total sum of looping angles on all yarn guides, without thereby affecting simultaneously the distance of the yarn path from the heated surface.

The yarn guides of the known heating apparatus contact the yarn with a curved contact surface, with the yarn guides having not only the task of smoothing the yarn path and of establishing it at a defined distance from the groove bottom. Rather, the yarn guides are also very important for the heat transfer.

It is the object of this invention to optimize in a false twist crimping machine the heat transfer of the yarn heating apparatus by a special configuration of the yarn guides.

SUMMARY OF THE INVENTION

The above and other objects and advantages of the present invention are achieved by the provision of a yarn heating apparatus which, in the preferred embodiment, comprises an elongate rail which includes at least one axial groove extending along the length thereof, with the axial groove defining a base wall, opposite side walls, and a central plane which is parallel to the side walls and equally spaced therebetween. A heater is mounted in the rail, and a plurality of recesses are formed in each of the opposite side walls, with the axially adjacent recesses being arranged in alternate ones of the side walls. Also, a cylindrical yarn guide is disposed in each of the recesses, with the axes of the cylindrical yarn guides being disposed substantially perpendicular to the base wall. The peripheries of the yarn guides thus define curved contact surfaces which extend beyond the central plane, such that a yarn advancing along the groove assumes a zigzagged path in contact with the curved contact surfaces of the yarn guides.

It is customary in the art to differentiate between so-called "contact heaters" and "noncontacting heaters."

The invention is based on the recognition that in a false twist crimping machine for crimping a synthetic filament yarn, a heater with a plurality of yarn guides is, with a suitable configuration of the yarn guides, a contact heater and has its properties. In the false twist crimping machine, the yarn heating apparatus is arranged directly upstream of the false twist unit in a zone of the yarn path, in which the synthetic yarn rotates in addition very rapidly, thereby imparting twist to the yarn, which is withdrawn in the false twist unit. As a result of this rotation, the yarn is surrounded by a layer of air, which impedes the heat transfer. The invention is therefore based on the fact that the yarn guides in the known heating apparatus, when they are used in a false twist crimping machine, result in that the yarn heating apparatus is a contact heater, and that a special importance for the heat transfer is attributed to the configuration of the contact surfaces. On the one hand, the present invention avoids that the extension of the twist in the direction opposed to the yarn advance is hindered. On the other hand, however, this invention effects an adequately close contact of an adequate yarn length with the contact surface of the yarn guide. The formation of an air jacket hindering the heat transfer is prevented, and an air jacket already formed is effectively stripped. In this connection, the yarn guides are designed such that the yarn heating apparatus has adequately good properties for all yarn deniers to be processed by false twist crimping, and that it is ideally designed for the lower denier range of about 20 dtex. Of importance for the specified dimension is the formula:

$D=0.0355\times A/U\times\sqrt{T}$, wherein

D=diameter of contact surfaces or average diameter of two successive contact surfaces;

U=overlap of successive yarn guides or amplitude of the zigzag line;

A=spacing between two successive yarn guides; and

T=denier, expressed in dtex, i.e.: grams per 10,000 meters.

Irrespective of and in addition to the thermodynamic objective which is accomplished by claim 1, and specifically with respect to the use of the yarn heating apparatus in a false twist crimping machine, a further problem arises for such heaters, namely, that the temperature control on the yarn is of decisive importance for the quality of the crimped yarn. It is therefore necessary to define the yarn path in a very precise and accurately reproducible manner.

In a preferred embodiment, the yarn guides are cylindrical, the peripheries of which form the curved contact surfaces, and the recesses have a cylindrical cross section which is adapted to closely receive the cylindrical yarn guides. The use of such cylindrical yarn guides permits not only a very accurate and reproducible dimensioning of the yarn guides, but also the likewise important, accurate dimensioning of the recesses, which receive the yarn guides with a close tolerance, but without a press fit. It is possible to fit the yarn guides substantially free of play into these recesses. Thereafter, it is only necessary to secure them in axial direction.

Such a fastening, which is simple to remove and insert, and therefore allows worn or damaged yarn guides to be easily replaced.

In this connection, one should have the guarantee that the yarn can be inserted in a simple manner, without having to reach with one's hands into the heater heated to more than 200° C. It is therefore necessary to ensure that the yarn is tensioned, when inserting it, and forms a straight line. This problem is overcome by providing a conical bevel on the outer ends of the cylindrical yarn guides.

For a better utilization of the heat, a yarn heating apparatus is suitable for at least two yarns. In this case, the rail is provided with two parallel grooves, which allows a substantial savings in material and manufacturing expenditure to be realized.

As already indicated, the configuration of the yarn guides, is significant primarily from a thermodynamic viewpoint in that a yarn insulating air jacket cannot develop or is stripped. This objective is accomplished, even when only few of the yarn guides reach this target in full, whereas others do so only in part.

Further, as already indicated, it is necessary that the yarn be guided with great accuracy not only along its zigzagged line, but also relative to the heating surface. This problem is solved by the guide edge which is formed on the yarn guides or by spacers which bridge over the groove at a distance above the groove bottom.

The uniform heating of the yarn by the heater is possible only, when the yarn heater and the heating surface formed on it receive an amount of heat which is adequate and constant over the length of the yarn heating apparatus. This is accomplished for the sake of simplicity by an elongate, bar-shaped resistance heater. Yet, there exists the problem that these electric heating rods need to have on the one hand an intimate, highly heat-conductive contact with the hot plate, whereas on the other hand they should be easily exchangeable. This problem is solved by the provision of axial grooves in the rail which accommodate resistance heaters, and with a clamping member for securing and covering the resistance heaters.

The yarn heating apparatus described in U.S. Pat. No. 5,148,666 consists of two elongate heating segments, which are inclined relative to one another in roof shape, so that the two yarn heating segments form with each other an obtuse angle. Also this positioning needs to be carried out with great accuracy, especially when it is intended to be easily adjustable and reproducible. This is achieved by providing a mounting support to which the two rails are attached by spacers.

BRIEF DESCRIPTION OF THE DRAWINGS

Some of the objects and advantages of the present invention having been stated, other will appear as the description proceeds, when considered in conjunction with the accompanying drawings, in which.

DETAILED DESCRIPTION OF THE PREFERRED EMBODIMENTS

Figure 1:
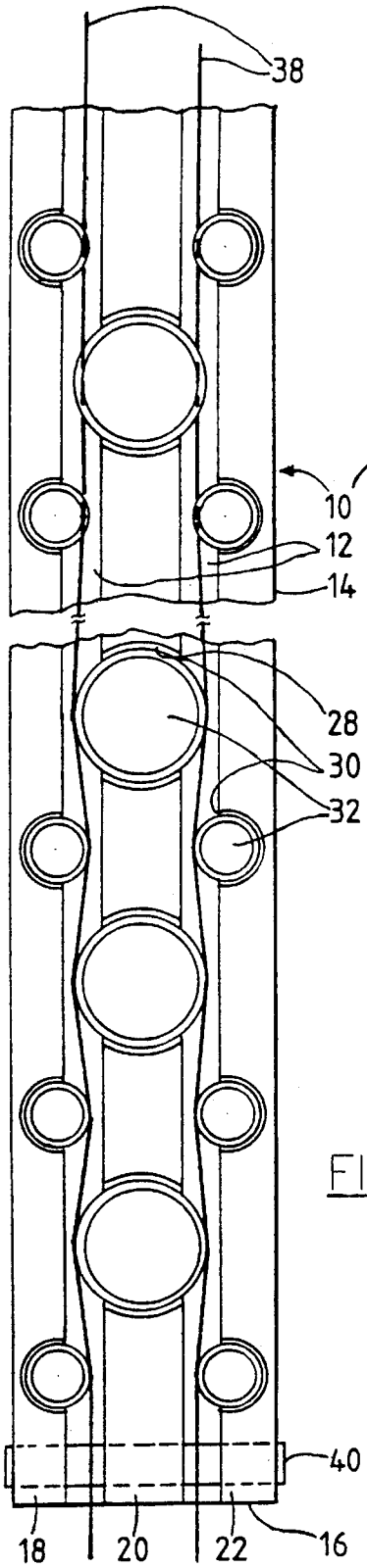
FIG. 1 is a top plan view of a yarn heating apparatus in accordance with the invention with a double groove.
Figure 2:
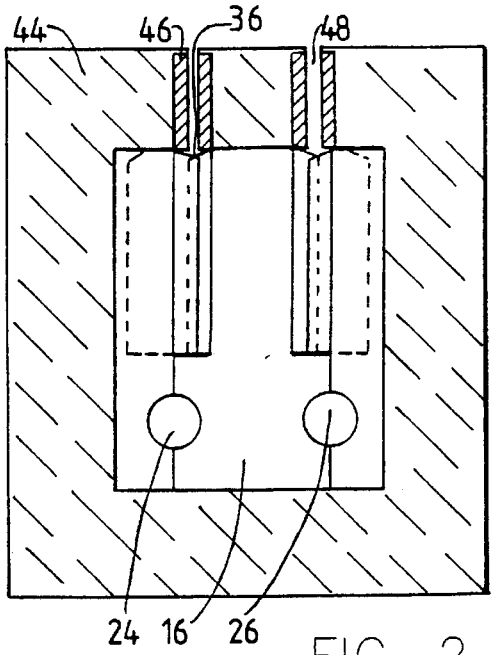
FIG. 2 is a front view of the yarn heating apparatus shown in FIG. 1, with a schematic view of the insulating box surrounding same.

A heating apparatus 10, as shown in FIGS. 1–5, consists of an elongate body or rail 14 provided with two longitudinal grooves 12 and composed of a material which is heat resistant and nonscaling, such as for example a copper alloy, and which is resistant to temperatures in a range above 450° C. over long periods of time without undergoing noteworthy changes. The rail 14 includes a substantially flat base 16, which represents the heating surface. Connected with the base are three walls 18, 20, 22, between which axial grooves 12 are located. However, it is also possible to provide base 16 with two or more than three upwardly directed walls, between which correspondingly less or more grooves extend. The outer walls 18 and 22 may, for example, be bolted to base 16. Arranged between walls 18 and 22 and base 16 is one heating element 24, 26 each, preferably in the form of a rod-shaped, electrical resistor, which extends over the entire length of rail 14, or which may also be divided over the length into several segments, so as to enable controlled heating profiles. The heating elements 24, 26 are provided with plug contacts not shown for their connection to a source of current.

Center wall 20 which is located between outer walls 18 and 22 and extends vertically from base 16, either is integral therewith, or it is connected with base 16 in like manner as outer walls 18 and 22.

As an alternative, rail 14 may have a cross section similar to an extruded profile, in which base 16 and walls 18, 20, 22 are made of one piece, and which is provided in known manner with recesses, bores, bendable flaps, or the like.

Inserted in walls 18, 20, 22 at regular intervals A from one another are recesses or bores 28 having substantially the same depth, with recesses 28 arranged in center wall 20 being offset by a spacing A from recesses 28 in side walls 18 and 22. The recesses have a circular-cylindrical shape. Each recess 28 is intersected by axial grooves 12 along a secant line, so that walls 18, 20, 22 exhibit a slot 30, i.e. a rectangular opening, facing the axial grooves 12. In the illustrated embodiment, the recesses extend perpendicularly to the groove bottom, and their depth corresponds to the height of walls 18, 20, 22, in which they are accommodated. Under certain circumstances, it may be advantageous to incline the recesses.

Each recess 28 accommodates a yarn guide the cross sectional shape of which corresponds to the cross section of the recess both in size and shape, and which, for purposes of maintaining close tolerances, rests firmly, but with a play, against the wall of the recess. The clearance between the wall of the recesses and the peripheral surface of the yarn guides, as shown in the drawing, is exaggerated only for reasons of clarity. In the region of each slot 30, a portion of each yarn guide 32 extends into the axial grooves 12 such that, on opposite sides of grooves 12, successively arranged yarn guides 32 extend by a certain dimension, for example 0.1 to 1 mm, beyond a central plane extending parallel to walls 18, 20, 22. Otherwise, the width of each slot 30 is smaller than the largest cross sectional dimension, i.e., than the diameter of yarn guides 32, so that they are unable to slide out of recesses 28.

Figure 4A:
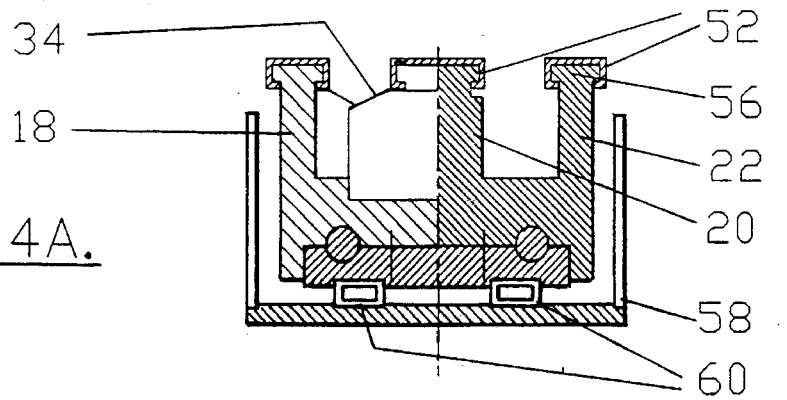
FIG. 4A is a sectional view taken along the section line indicated in FIG. 4.
Figure 4:
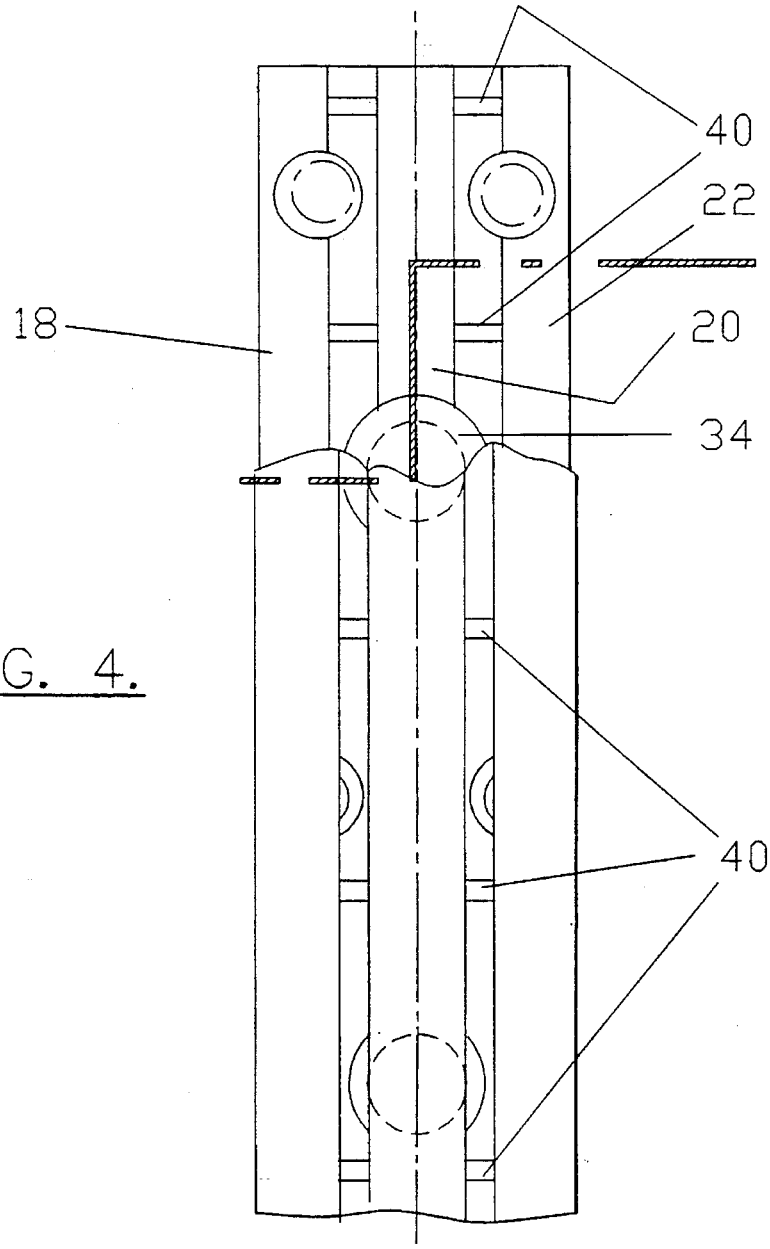
FIG. 4 is a top plan view of a modified embodiment.
Figure 5A:
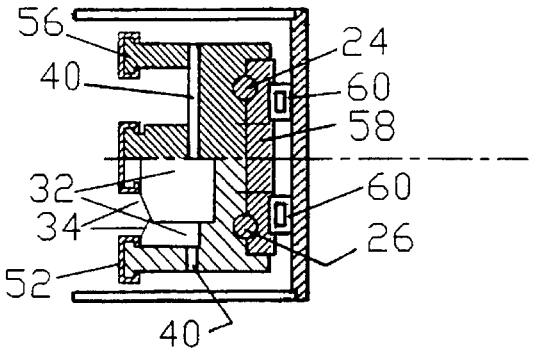
FIG. 5A is a sectional end view of the heating apparatus shown in FIG. 5.
Figure 5:
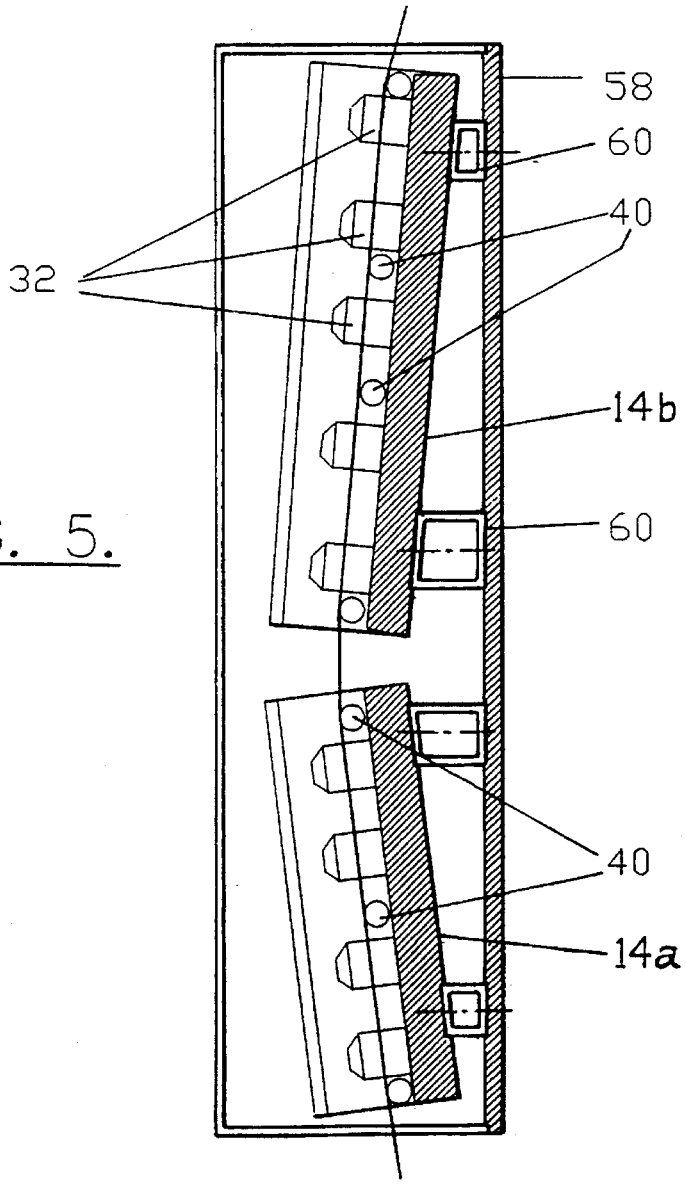
FIG. 5 is a sectional side view of a heating apparatus with two elongate heating segments.

In the illustrated embodiments, both recesses 28 and yarn guides 32 have a circular-cylindrical cross section. Other angular as well as rounded shapes, such as ellipses, diamonds, triangles, etc. are possible. The embodiment of FIGS. 1, 2 has a fit between recesses 28 and yarn guides 32, which is kept within accordingly close tolerances. As a result, separate fastening means to secure yarn guides 32 against axial and radial displacement is not needed, thereby eliminating special expenses, which would otherwise result from the use of fastening means. In the embodiments of FIG. 4 and 5, clearance fits are selected. On the one hand, these clearance fits are narrow enough, so that the yarn guides rest unmovably in their recesses. On the other hand, however, the clearance fits are also selected wide enough, so as to make it easy to pull out the yarn guides from their recesses and replace same. For purposes of securing the yarn guides in the axial direction, sheet metal caps 52 are used. To this end, side walls 18, 20, 22 are provided on their upper edge with retaining grooves 54 or a head 56, which is wider than the respective wall. In cross sectional view, the sheet metal caps have a cup-shaped profile, so that in the case of center wall 20 they extend into retaining grooves 54, or that in the case of side walls 18, 22 they embrace wall head 56. Otherwise, the sheet metal caps are constructed as elongate profiles, the length of which corresponds to that of the yarn heater. The thickness of wall heads 56 and the position of retaining grooves 54, respectively, and the corresponding dimensioning of the sheet metal caps are such that the sheet metal caps secure the yarn guides in axial direction.

The yarn guides consist of materials commonly used for this purpose, such as silicon, titanium, or aluminum oxides, or of nitrided or chromium plated steel, or the like.

Preferably, in the region, in which they project from recess slot 30, the yarn guides 32 are conically beveled on their ends facing away from bottom 16, as is indicated at 34. As a result, the yarn guides 32 successively arranged in opposite walls 18 and 20, or 22 and 20 form in the cross sectional direction of the heating apparatus 10 respectively a V-shaped groove 36, which permits to guide a yarn 38 in its stretched condition between yarn guides 32, without any special auxiliary measures or arrangements between successive yarn guides 32, in a movement substantially perpendicular with respect to base 16. There, the yarn resting against the contact surfaces forms then a zigzagged yarn path (FIG. 1).

Arranged at the ends (see FIG. 1), or at several other points (see FIGS. 4, 5) of rail 14, and substantially equally spaced apart, are spacers 40, which bridge each over groove 12, and of which only one is shown in FIG. 1. These yarn guide elements have an upward directed yarn guide surface, which serves to maintain a distance between a yarn 38 and the groove bottom. These rod-shaped spacers 40 are anchored in transverse bores provided in the walls 18, 20, 22.

As shown in FIG. 5, heating apparatus 10 may consist of two rail segments 14*a* and 14*b*, one following the other in direction of the advancing yarn. While these segments differ in length, they have otherwise the same cross sectional shape. The purpose of such a bipartite arrangement may lie in the different heating of heating apparatus be over different length segments, so as to treat yarn 38 in a heat profile which satisfies its properties. It is also possible to use more than the two illustrated segments. In this arrangement, it is especially important that the angle which the two yarn heating segments form with one another, is identically adjusted at each processing station of the false twist crimping machine, so as to produce yarns of the same quality on all processing stations. To mount the two yarn heating segments a support 58 is used. The latter is a rail which has the length of the two heater segments. The mounting support has a U-shaped cross section. The yarn heating segments are attached to the bottom of the mounting segment by means of spacers 60. The dimensioning of the spacers and their position relative to the heating segment allow to define the inclination of the heating segment with respect to the straight mounting support 58. In the illustrated arrangement, the two heating segments are inclined oppositely, and form with each other an obtuse angle. Thus, mounting support 58 is used on the one hand for a specific fastening of the two heating segments. Since mounting support 58 has a U-shaped profile, it embraces, however, also the two heating segments. Therefore, the mounting support 58 also serves to make the temperature constant over the length and width of the heating segments. The mounting support is surrounded by an insulation.

Figure 3A:
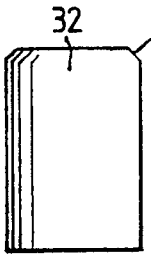
FIGS. 3A, 3B, and 3C are side views of preferred embodiments of the yarn guides used in the heating apparatus of the present invention.
Figure 3B:
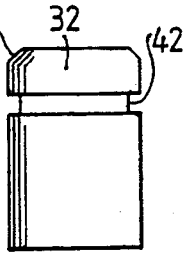
Figure 3C:
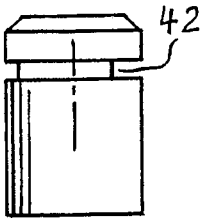

As already indicated, rod-shaped spacers 40 may be provided, which bridge over axial groove 12 on its bottom, i.e., they extend over the heating surface and define the yarn path at a specific distance from the groove bottom. Alternatively or additionally, it is possible to provide a few or all yarn guides 32 with a peripheral guide edge, for example, a circumferential groove 42, the height of which from the groove bottom is brought in line with the height of the yarn path that is predetermined by guide members 40. In this manner, the yarn advancing in the groove is guided through the lateral edges of the groove. The circumferential grooves have the same depth over the circumference, i.e., they are made concentric with yarn guides 32. However, it is also possible to construct the circumferential grooves with a depth varying over the circumference, for example, in that the groove bottom is cut circular-cylindrically, but eccentrically with respect to yarn guides 32, as illustrated in FIG. 3*c*. In this instance, a turning of the yarn guides creates the possibility of a fine adjustment of the contact between yarn 38 and yarn guides 32, and of the zigzagged yarn path. This could be realized by turning the yarn guides 32 jointly and to the same extent, for example, by means of a linkage interconnecting them.

Moreover, the heating apparatus 10 is accommodated in an insulated box 44 (FIG. 2), in which it is embedded in a thermally insulated material, for example, fiber glass. The insulated box 44 may be provided with a flap (not shown), which permits it to be opened, so as to provide access to heating apparatus 10, and to thread the yarn. Furthermore, the insulated box 44 in the embodiment of FIG. 2 serves with its elements extending over heating apparatus 10 to axially secure yarn guides 32 in rail 14. To this end, the insulated box 44 is provided with slots 48, which are aligned with the central plane 50 and the bevels 34 of yarn guides 32, and which permit a yarn 38 to be treated to be placed between the yarn guides 32. On their side walls, the slots are provided with wear-resistant insulating plates 46.

Likewise, if need be, the electrical contacts required for heating elements 24, 26 are accommodated in insulated box 44.

As can be noted from all embodiments, the surfaces, on which the yarn guides contact the yarn, have a relatively large diameter. Contrary thereto, the zigzag line, along which the yarn advances as a result of the overlap U (FIG. 6) of successive yarn guides, has a relatively small amplitude with a relatively large spacing A between two neighboring yarn guides. This permits the looping angle, at which the yarn loops about the yarn guides or the contact surfaces formed on same, to be small when summed. As a result, the twist of the yarn in the false twist zone of a false twist crimping machine is not impeded. Nonetheless, due to the large diameter, the contact length of the yarn is sufficient, so as to allow a low-denier yarn (for example 20 dtex) to turn once about its axis when passing over a yarn guide, and to thereby completely strip off the air jacket, which surrounds the yarn and obstructs the heat transfer.

Figure 6:
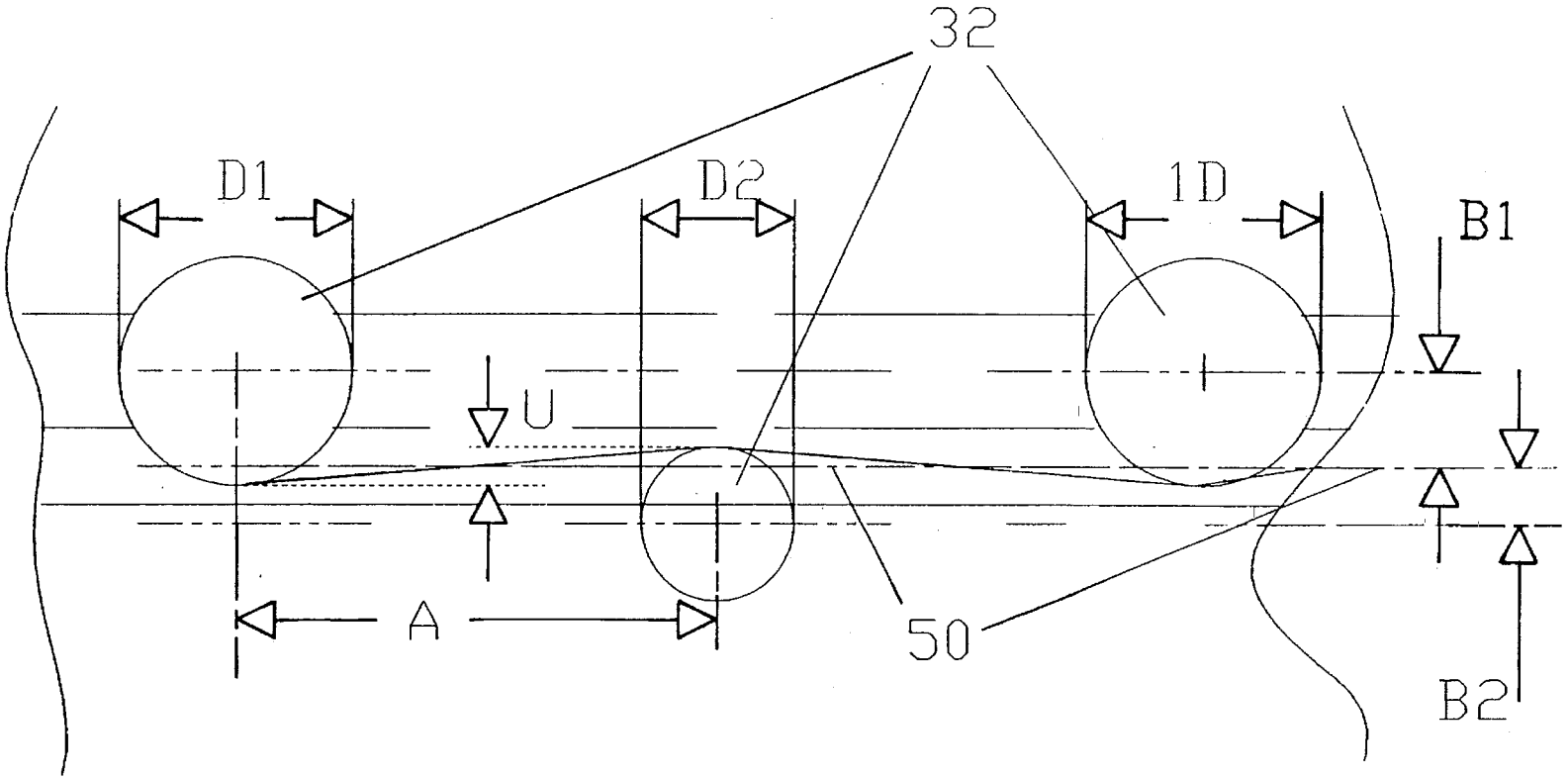
FIG. 6 is a schematic view of three successive yarn guides to illustrate their dimensions.

A higher-denier yarn needs to advance over two or three yarn guides, so as to perform a complete turn. However, since the number of the yarn guides distributed over the length of the yarn heater, and in particular the number of the yarn guides distributed over several heater segments, amounts to at least twice as much, it is ensured that, as the yarn advances through the heating device, the air jacket surrounding the yarn is totally stripped off twice in any event. As shown in FIG. 6, yarn guides are used with different diameters D1 and D2. The yarn guides are arranged at equal spacings A. The yarn path forms a zigzag line. Twice the amplitude of this zigzag line is indicated at U. This dimension U is identical with the overlap of two successive yarn guides, which results from the fact that the successively arranged yarn guides extend each beyond central plane 50.

In the preferred embodiment, the distance U is between 0.6% and 1.5% of the spacing A, and most preferably the distance U is between 0.9 and 1.4% of the spacing A. The diameter of the cylindrical yarn guides is preferably between 8 and 25 mm, and most preferably between 10 and 20 mm.

When within the scope of this application reference is made to the diameter of the yarn guides or contact surfaces, same is understood to be the mean diameter of two yarn guides, one following the other in the path of the yarn. As can be noted from FIG. 6, the overlap U results from the formula:

$$(D1/2-B1)+(D2/2-B2).$$

In the embodiment of FIGS. 4 and 5, the yarn heater is provided on its side facing away from axial groove 12 with two grooves, which extend substantially below respective ones of the yarn guide grooves 12. Inserted into these grooves are heating elements 24 and 26. The heating elements are clamped in place by a mounting support 58, which extends over the entire length of the yarn heater. To this end, the mounting support is likewise provided with grooves, which surround heating elements 24, 26. When detaching the mounting support 58, heating elements 24, 26 can be easily exchanged.

I claim:

1. A yarn heating apparatus for use in a false twist crimping machine comprising:

an elongate rail defining a heating surface, means for heating the heating surface, a plurality of cylindrical yarn guides mounted in an axially spaced apart arrangement along the rail, with the axes of the cylindrical yarn guides being disposed substantially perpendicular to the heating surface, with axially adjacent yarn guides being positioned on opposite sides of a common central plane which is generally perpendicular to the heating surface, and with the yarn guides being sized and positioned such that the peripheries thereof extend beyond the common central plane and present curved contact surfaces to a yarn advancing along the rail, whereby a yarn advancing along said rail assumes a zigzagged path in contact with the curved contact surfaces of the yarn guides.

2. The yarn heating apparatus as defined in claim 1, wherein the yarn guides are sized and positioned such that the zigzagged course of the advancing yarn defines a distance U which is twice the amplitude of the zigzagged yarn path, and a spacing A between adjacent yarn guides, and wherein the distance U is between 0.6% and 1.5% of the spacing A, and the diameter of the cylindrical yarn guides is between 8 and 25 mm.

3. A yarn heating apparatus for use in a false twist crimping machine comprising:

an elongate rail which includes at least one axial groove extending along the length thereof, with the axial groove defining a base wall, opposite side walls, and a central plane which is parallel to the side walls and equally spaced therebetween, means for heating the rail, a plurality of recesses formed in each of said opposite side walls, with the axially adjacent recesses being arranged in alternate ones of the side walls, and a cylindrical yarn guide disposed in each of said recesses, with the yarn guides each including a curved contact surface which extends beyond the central plane, whereby a yarn advancing along said groove assumes a zigzagged path in contact with the curved contact surfaces of the yarn guides.

4. The yarn heating apparatus as defined in claim 3, wherein the cylindrical yarn guides define axes which are substantially perpendicular to the base wall of the axial groove, and wherein the recesses have a cross sectional configuration which closely conforms to that of the associated cylindrical yarn guides.

5. The yarn heating apparatus as defined in claim 4, wherein the recesses each form a gap in the associated side wall, through a portion of which a portion of each yarn guide extends into the groove, with the portion which extends into the groove being smaller than the portion located in recess.

6. The yarn heating apparatus as defined in claim 5, wherein the yarn guides are conically beveled on their end facing away from the base wall.

7. The yarn heating apparatus as defined in claim 3, wherein at least some of the yarn guides are provided at a distance from the groove base wall with a circumferential guide groove, which establishes the yarn path.

8. The yarn heating apparatus as defined in claim 3, further comprising a plurality of spacers which bridge across the groove at a distance from the groove base wall.

9. The yarn heating apparatus as defined in claim 3, wherein each of the side walls is covered by a sheet metal cap which extends in the axial direction of the yarn heater, and which rests on the end surfaces of the yarn guides and covers at least a portion of the end surfaces of the yarn guides extending beyond the side walls.

10. The yarn heating apparatus as defined in claim 3, wherein the rail is provided with axial grooves on the side thereof opposite the axial groove, which accommodate resistance heaters, and wherein a clamping member secures the resistance heaters to the rail and covers the same.

11. The yarn heating apparatus as defined in claim 3, wherein the rail comprises at least two segments, with the two segments being supported by an elongate, straight mounting support, to which the at least two yarn segments are attached by means of spacers, and such that the two segments have an upward and downward inclination, respectively, in the axial direction.

12. The yarn heating apparatus as defined in claim 11, wherein the mounting support is constructed as a U-section, the side flanks of which surround the yarn segments.

13. A yarn heating apparatus for use in a false twist crimping machine comprising:

an elongate rail which includes at least two parallel axial grooves extending along the length thereof so as to define outer side walls and a partition wall therebetween, and with each of the grooves further defining a base wall and a central plane which is parallel to the groove and equally spaced between the associated side wall and the partition wall, means for heating the rail, a plurality of recesses formed in each of said outer side walls and said partition wall, with the axially adjacent recesses of each of said grooves being arranged in alternate ones of the associated side wall and the partition wall, and a cylindrical yarn guide disposed in each of said recesses, with the yarn guides each including a curved contact surface which extends beyond the central plane of at least one of the grooves, whereby a yarn advancing along either of said grooves assumes a zigzagged path in contact with the curved contact surfaces of the yarn guides.

14. The yarn heating apparatus as defined in claim 13 wherein the cylindrical yarn guides define axes which are substantially perpendicular to the base wall of the associated axial groove, and wherein the recesses have a cross sectional configuration which closely conforms to that of the associated cylindrical yarn guides.

15. The yarn heating apparatus as defined in claim 14 wherein the recesses each form a gap in the associated wall, through which a portion of each yarn guide extends into the groove, with the portion which extends into the groove being smaller than the portion located in recess.

16. The yarn heating apparatus as defined in claim 15 wherein the recesses in said partition wall define segments of a circle, and wherein the width of the partition wall is greater than the radius of the defined circle and less than the diameter of the defined circle, and such that each yarn guide which is inserted in a recess in the partition wall extends outwardly into each of the grooves and beyond the central plane thereof.

17. The yarn heating apparatus as defined in claim 16, wherein the diameter of the yarn guides inserted in partition wall is greater than the diameter of the yarn guides inserted in the side walls.

* * * * *